US008764474B2

(12) United States Patent
Sakaguchi

(10) Patent No.: US 8,764,474 B2
(45) Date of Patent: Jul. 1, 2014

(54) CONNECTOR WITH LEVER AND WIRE COVER

(75) Inventor: Soichi Sakaguchi, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 10 days.

(21) Appl. No.: 13/597,958

(22) Filed: Aug. 29, 2012

(65) Prior Publication Data

US 2013/0052857 A1 Feb. 28, 2013

(30) Foreign Application Priority Data

Aug. 29, 2011 (JP) ..... 2011-185587

(51) Int. Cl.
*H01R 13/62* (2006.01)

(52) U.S. Cl.
USPC ..... 439/372; 439/157

(58) Field of Classification Search
USPC ..... 439/372, 157
See application file for complete search history.

(56) References Cited

U.S. PATENT DOCUMENTS

| | | | | |
|---|---|---|---|---|
| 6,602,082 | B2 * | 8/2003 | Nishide et al. | 439/157 |
| 7,025,610 | B2 * | 4/2006 | Demuth | 439/157 |
| 7,137,844 | B2 * | 11/2006 | Flowers et al. | 439/372 |
| 7,419,390 | B2 * | 9/2008 | Ohtaka et al. | 439/157 |
| 2007/0197081 | A1 * | 8/2007 | Patterson et al. | 439/372 |
| 2010/0323537 | A1 * | 12/2010 | Vasbinder et al. | 439/65 |
| 2013/0052857 | A1 * | 2/2013 | Sakaguchi | 439/372 |
| 2013/0280935 | A1 * | 10/2013 | Shishikura et al. | 439/157 |

FOREIGN PATENT DOCUMENTS

| | | | |
|---|---|---|---|
| JP | 2009-242609 | A | 10/2009 |
| JP | 2009-272046 | A | 11/2009 |

* cited by examiner

*Primary Examiner* — James Harvey
(74) *Attorney, Agent, or Firm* — Barley Snyder

(57) ABSTRACT

A lever-type connector having a cover and a lever. The cover includes a body and a lock with a spring section connected to the body and an engaging section connected to the spring section. The lever connects to the body and includes a rotatable pair of arms facing each other and a coupling part connecting the rotatable pair of arms together. The coupling part is engageable with the lock when the lever is rotated toward the lock and includes a cover section covering the engaging section and a portion of the spring section when the lock engages the lever.

17 Claims, 5 Drawing Sheets

CONNECTOR WITH LEVER AND WIRE COVER

CROSS-REFERENCE TO RELATED APPLICATION

This application claims the benefit of the filing date under 35 U.S.C. §119(a)-(d) of Japanese Patent Application No. 2011-185587, filed Aug. 29, 2011.

FIELD OF THE INVENTION

The present invention relates to a connector and, more particularly, to a connector having a lever.

BACKGROUND

In recent years, known electric connectors having numerous terminals are being used in the field of automobiles and are becoming more advanced. With an electric connector having numerous terminals, a large force is required to mate together connectors and release the connection. For this reason, a known lever-type connector having a lever is used to assist the mating with and release from a mating connector (for example, Japanese Patent Application Laid-Open No. 2009-272046).

In the known lever-type connector, the lever is rotated from a mating start position to a mating completion position to complete mating with the mating connector. The known lever-type connector is provided with a lock that hinders rotation of the lever from the mating completion position toward the mating start position.

As described in Japanese Patent Application Laid-Open No. 2009-272046, the lock may be provided to a wire cover covering a wire connected to a contact, as shown in FIGS. 5A and 5B. A wire cover 40 is mounted on a housing of the known lever-type connector. A wire 2 is drawn from one end side of the wire cover 40, which is provided with a lever 50 assisting in mating with a mating connector 70 and a lock 60 that engages the lever 50 once the known lever-type connector is positioned in the mating completion position. The lock 60 includes a spring section 61, and an engaging section 62 and a release projection 63 each connected to the spring section 61. The lever 50 has a catch 51 to be engaged with the engaging section 62 of the lock 60.

When the lever 50 is rotated toward the mating completion position at the time of mating with the mating connector, the catch 51 pushes the engaging section 62 downward so that the spring section 61 deflects. When the lever 50 is further rotated, the catch 51 goes over the engaging section 62. At this moment, the spring section 61 resiliently deflects backward. A clicking sound and a physical touch are realized by the operator when the engaging section 62 abuts on the catch 51, and thereby completion of connection with the mating connector can be confirmed.

In the known lever-type connector as described in Japanese Patent Application Laid-Open No. 2009-272046, when the lever is rotated to the mating completion position, the engaging section 62 extending from the spring section 61 and the spring section 61 may become pressed with a finger F as shown in FIG. 5B depending on the position of the finger of the hand when the lever is operated. As a result, the finger F may cause the spring section 61 to maintain deflection without reticently deflecting backward to it resting position. Therefore, recovery of the spring section 61 is inhibited, and the operator may not realize the sound or a touch that indicates completion of mating when the engaging section 62 abuts on the catch 51, and the completion of mating the connectors may not be cannot be confirmed.

Therefore, it has to be confirmed that the lever cannot be rotated to a mating start position side, or a redoing operation is required such that the release projection 63 is pushed downward to release locking to once return the lever to the mating start position side and then again the lever is rotated to the mating completion position, thereby degrading operability.

SUMMARY

The present invention was made based on the problems as described above, and includes the objective, among others, to provide a lever-type connector having a cover and a lever. The cover includes a body and a lock with a spring section connected to the body and an engaging section connected to the spring section. The lever connects to the body and includes a rotatable pair of arms facing each other and a coupling part connecting the rotatable pair of arms together. The coupling part is engageable with the lock when the lever is rotated toward the lock and includes a cover section covering the engaging section and a portion of the spring section when the lock engages the lever. The present invention is directed to a connector with a lever, and the lever includes a pair of lever arms rotatable from an operation start position to an operation completion position and facing each other and a coupling part coupling tips of the pair of lever arms.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE PREFERRED EMBODIMENTS

The invention is described in detail below based on an embodiment shown in the accompanied drawings.

As shown in FIG. 1 to FIG. 4, a connector according to the invention includes a wire cover 10 that is mounted on a connector housing (not shown) to cover a wire (not shown) connected to a contact held in the connector housing. The wire is drawn from the wire cover 10 in a predetermined direction. The wire cover 10 and the connector housing configure an electrical connector mated with, for example, a mating connector 70 shown in FIG. 5A.

Figure 1:
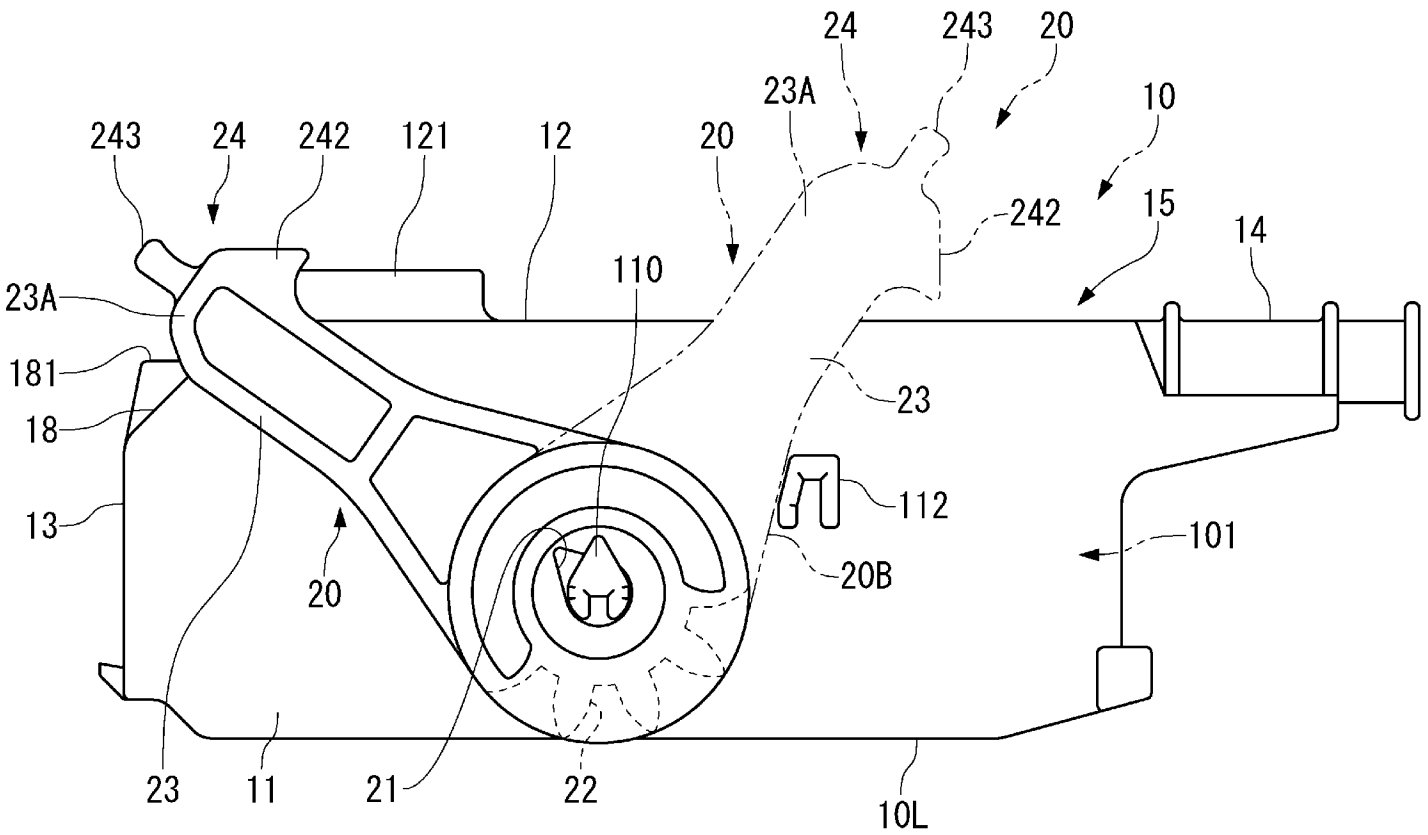
FIG. 1 is a side view of a connector according to the invention.
Figure 2:
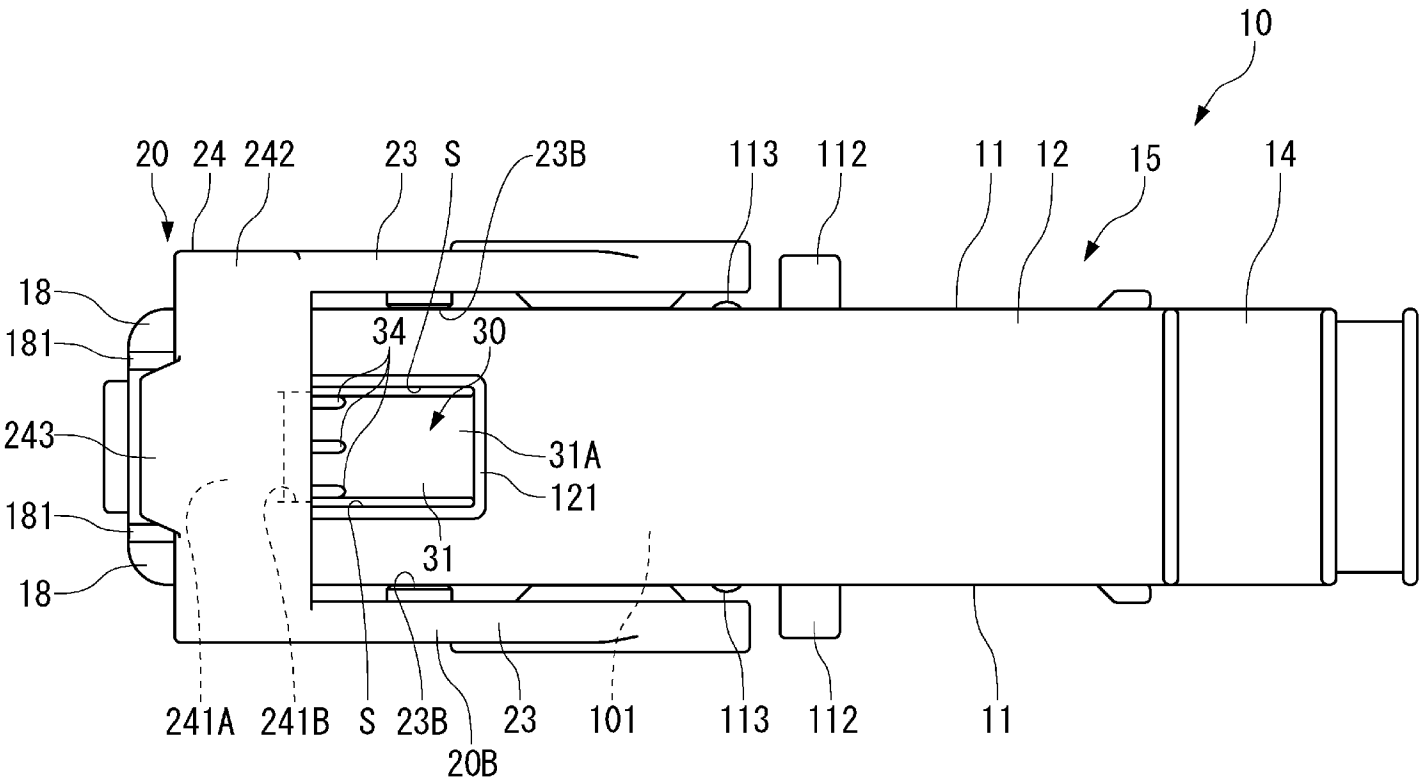
FIG. 2 is a top view of the connector according to the invention having a lever rotated to a mating completion position.
Figure 3:
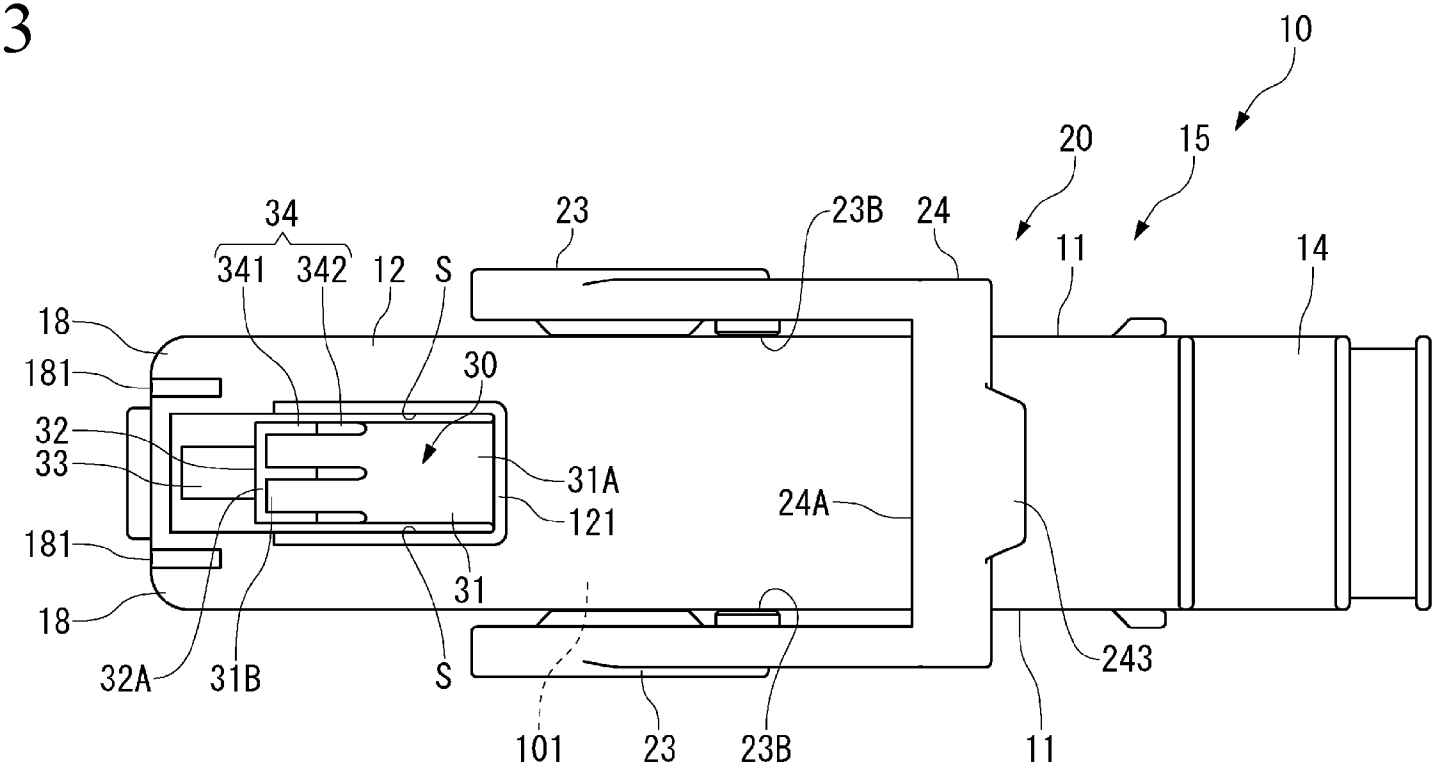
FIG. 3 is a top view of the connector when the lever is positioned at a mating start position.

Note in the exemplary embodiment that the top and the bottom in FIG. 1 are defined as top and bottom, and a side from which the wire is drawn from the wire cover 10 is defined as back and its opposite side (a side provided with a coupling wall 13) is defined as front.

The wire cover 10 in the shown embodiment includes a cover body 15, a lever 20 rotating in a clockwise direction or a counterclockwise direction between an mating starting position (hereinafter simply referred to a start position) indicated with a two-dot-chain line in FIG. 1 and an mating completion position (hereinafter simply referred to a completion position) indicated with a solid line in FIG. 1, and a lock 30 regulating rotation of the lever 20 once the lever 20 is rotated to the completion position.

In the embodiment shown, the cover body 15 is an insulating resin or the like and includes a hollow cavity with an open lower end part 10L side that is mounted on the connector housing, such that when viewed from a section the cover body 15 has a U shape. The cover body 15 includes a wire receiving space 101 therein where a wire is accommodated.

The cover body 15 includes a pair of side walls 11 facing each other along a width direction, an upper wall 12 coupling upper ends of the side walls 11 together, and a coupling wall 13 coupling the side walls 11 together on a front end side of the cover body 15.

Also, a hood 14 is provided on an upper part of the cover body 15, located on a back end side of cover body 15. The hood 14 has an arc shape in section that bundles wires and from which the bundled wires are drawn.

A projection 110 extends outward from the cover body 15 in a width direction and is positioned approximately around a center section of each side wall 11. In the embodiment shown, the lever 20 is rotatably supported on each projection 110 of the cover body 15.

Also, each side wall 11 is provided with a start position stopper 112 defining a start position of the lever 20 with a side surface 20B of the lever 20 abutting thereon and a lock projection 113 regulating rotation of the lever 20 at the start position toward the completion position by being inserted in a recessed part 23B formed on a back surface of the lever arm 23 of the lever 20.

A protection wall 121 is provided with the wire cover 10 and protects the lock 30 from damage. The lock 30 and the protection wall 121 are integrally formed with the upper wall 12.

The lock 30 has a spring section 31 with a support end 31A on a back end side thereof extending from and supported by the upper wall 12 to a tip 31B. The spring section 31 extends away from the upper wall 12 in a cantilever manner. The lock 30 also includes an engaging section 32 continuing upward from the tip 31B and engaging the lever 20, more specifically a catch 241 of a coupling part 24, and a release projection 33 continuing from the tip 31B downward away from the lever 20.

The spring section 31 is integrally formed with the upper wall 12, with the support end 31A as a fixed end. A pair of slits S are positioned between the spring section 31 and the upper wall, extending from the front end of the upper wall 12 to the back being where the support end 31A connects to the upper wall, so as to be spaced apart from each other in a width direction of the upper wall 12, The engaging section 32 is a plate-shaped member that is connected to the tip 31B of the spring section 31 and displaces in conjunction with deflection of the spring section 31, and has an upper end 32A to engage the lever 20.

The engaging section 32 is supported by a plurality of ribs 34. The ribs 34 are provided on the upper surface of the spring section 31 from the engaging section 32 to the back. With the ribs 34, stiffness of the engaging section 32 mainly in a forward and backward direction is increased. The ribs 34 each have a support rib 341 continuing to the engaging section 32 and having the same height as the engaging section 32 and a connection section 342 having a height gradually decreasing from the support rib 341 toward a support end 31A side.

The release projection 33 projects forward from a lower end side of the tip 31B of the spring section 31. If this release projection 33 is pushed when the lever 20 is at the completion position, locking by the lock 30 is released to allow the lever 20 to rotate toward the start position.

The protection wall 121 extends from both of a top and bottom surface of the upper wall 12, positioned toward a front end side of the upper wall 12. The protection wall 121 also extends along the spring section 31. In the embodiment, the protection wall 121 has a U shape in a planar view. Additionally, in the embodiment shown, the spring section 31 is rectangular, and surrounded by the protection wall 121 except the tip 31B. The tip 31B of the spring section 31 projects further to the front than the protection wall 121. This protection wall 121 is set to have a height equivalent to those of the engaging section 32 and the support rib 341 of the rib 34. Also, the dimension of the protection wall 121 in a width direction is set to be substantially equivalent to the width of the spring section 31 and the slits S. This dimension is set so as not to allow a human finger F to easily enter the inside of the protection wall 121.

Note that the portion of the protection wall 121 on the back surface side of the upper wall 12 prevents the wire in the wire receiving space 101 from coming into contact with the spring section 31 so as not to affect deflection of the spring section 31.

The front end of the upper wall 12 and the upper end of the coupling wall 13 are connected together by a connection section 18 positioned at both end sides of the release projection 33 in the width direction and directed diagonally upward, such that the connection section 18 is sloped in the embodiment shown. The connection section 18 is provided with a mating stopper 181 projecting therefrom and defining a completion position by abutting on the front end 24A of the lever 20.

Now with reference to the Figures, the lever 20 will be described.

The lever 20 has a pair of lever arms 23 facing each other across both of the side walls 11, the coupling part 24 connecting the tips 23A of the lever arms 23 together, a pair of shaft holes 21 into which the projection 110 of the both side walls 11 is inserted, and a gear 22 formed around each shaft hole 21.

The projection 110 is inserted into the shaft holes 21 at an angle set so that a direction in which the shaft hole 21 and the tip 23A are connected coincides in a vertical direction. With the lever 20 rotated from this angle, the projection 110 is prevented from being removed from the shaft holes 21.

The gear 22 has an angle range positioned opposite to the tip 23A around the shaft hole 21, and engages with a rack provided on a connector housing of the mating connector.

The coupling part 24 has a catch 241 that engages the engaging section 32 of the lock 30 when the lever 20 is at the completion position, a cover section 242 having a rectangular plate shape in the embodiment shown and that covers the engaging section 32 and a tip 31B side of the spring section 31 (a portion near the tip 31B) when the lever 20 is rotated to the completion position, and a pressing projection part 243 for moving the lever 20.

The catch 241 is provided on the back surface of the coupling part 24. The catch 241 includes a pressing surface 241A and a recessed part 241B. The pressing surface 241A is used for pressing the engaging section 32 downward as the lever 20 is positioned closer to the completion position. The recessed part 241B is positioned on a back side of the pressing surface 241A and includes the engaging section 32 inserted thereinto when the lever 20 reaches to the completion position. The engaging section 32 engages an inner wall of the recessed part 241B from a back side. As long as the rotation of the lever 20 toward the start position is regulated in this manner, the inner wall of the recessed part 241B and the engaging section 32 may have a space therebetween.

The pressing projection part 243 is positioned at the center of the coupling part 24 in the width direction, and projects approximately along a direction of a radius of rotation of the lever 20. This pressing projection part 243 is provided on a front surface side of a portion of the coupling part 24 where the pressing surface 241A is located.

In the embodiment shown, the coupling part 24 is chevron shaped when the side wall 11 is viewed from the front, the shape being formed with the cover section 242 crossing a portion from a position near a base end of the pressing projection part 243 down to the front end 24A of the coupling part 24.

When the lever 20 is at the completion position, the cover section 242 extends approximately parallel to the upper wall 12 from the position of the engaging section 32 toward the start position. Here, the cover section 242 faces and covers the engaging section 32, the tip 31B side of the spring section 31, and the support rib 341. There is no space for the finger F to enter between the engaging section 32 and the support rib 341 of the rib 34 and the cover section 242.

Note that when the lever 20 is at the start position, as shown in FIG. 1, the cover section 242 is set so as not to abut on the upper wall 12.

To mate the connector and the mating connector by using the wire cover 10 as described above, with the lever 20 being positioned at the start position indicated with the two-dot-chain line in FIG. 1, the gear 22 is set to engage the rack of the mating connector to mount the wire cover 10 on the connector. In addition, both of the connector housings of the connector and the mating connector are set to face each other and, into the inside of one housing, an end of the other housing is inserted to lightly fit therein.

When the pressing projection part 243 of the lever 20 at the start position is pressed with the finger F toward the completion position, the lock projection 113 is disengaged from the recessed part 23B of the lever 20, thereby allowing the lever 20 to rotate to the completion position. When the pressing projection part 243 is then continuously pressed with the finger F, the connector housing is pushed toward the connector housing of the mating connector with a ganged operation of the gear 22 and the rack. At this moment, when the lever 20 comes near the completion position, the pressing surface 241A presses the engaging section 32, thereby causing the spring section 31 to deflect downward. In accordance with this deflection, the engaging section 32 and the release projection 33 are displaced downward. When the lever 20 is further rotated from there until the front end 24A abuts on the mating stopper 181, the pressing surface 241A goes over the engaging section 32, and the lever 20 reaches the completion position. At this moment, when the engaging section 32 together with the spring section 31 each return to its original position due to an elastic force of the spring section 31, the engaging section 32 is inserted into the recessed part 241B of the lever 20, thereby causing the lever 20 to be engaged at the completion position. As such, mating of the connector and the mating connector is completed.

Figure 4:
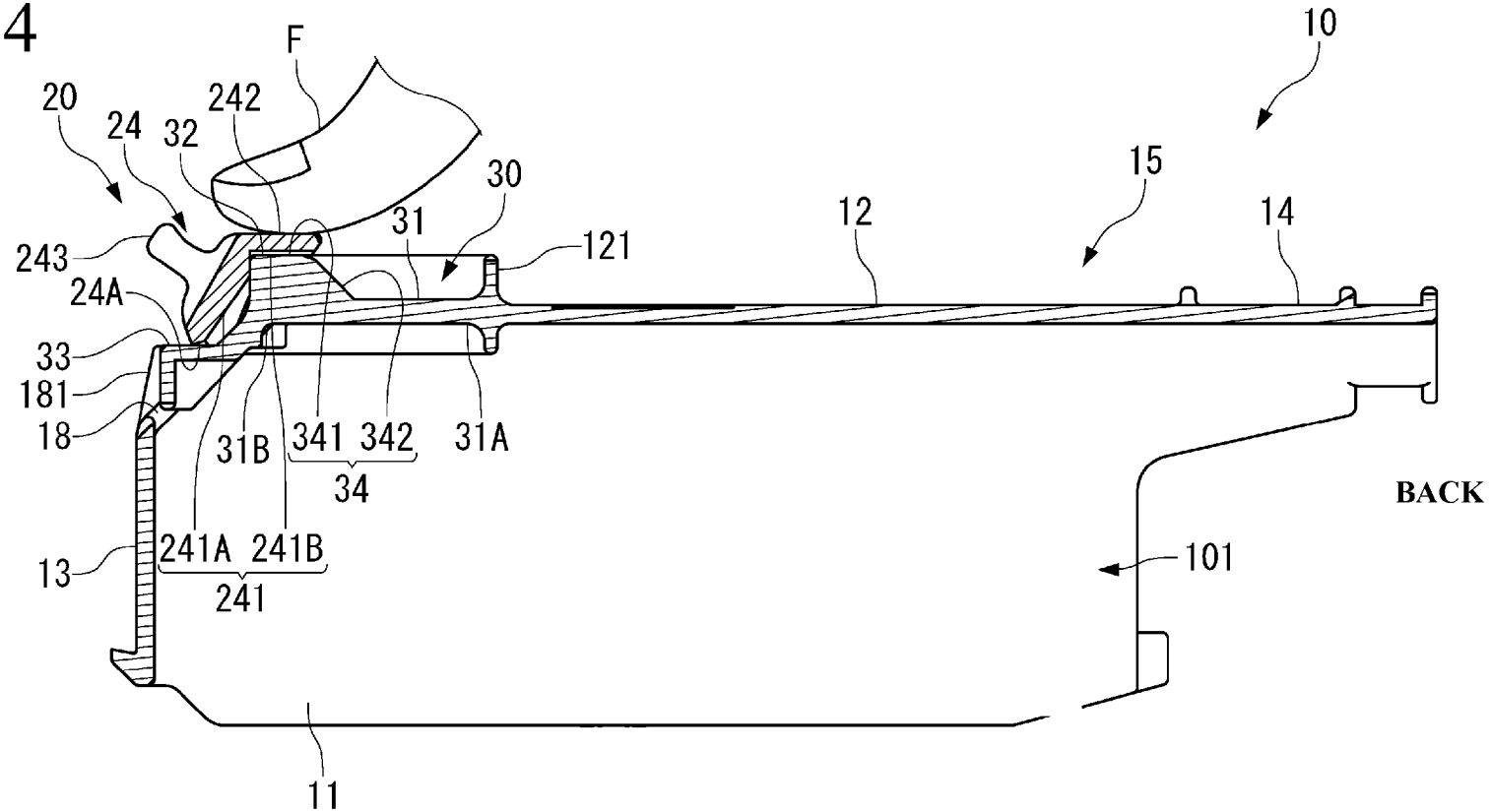
FIG. 4 is a sectional view of the connector according to the invention when the lever is rotated to the mating completion position.
Figure 5A:
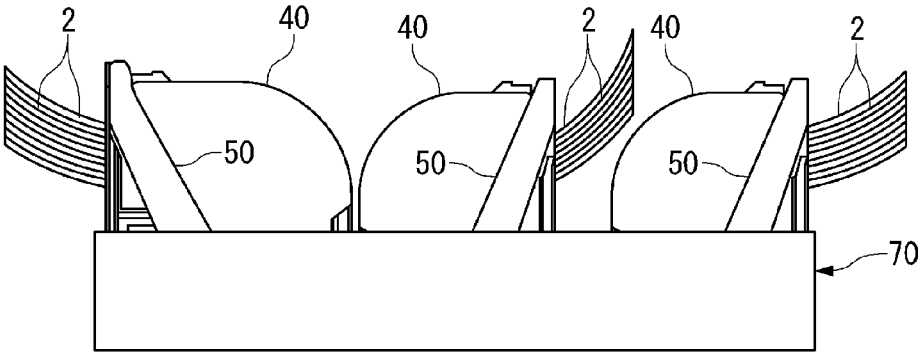
FIG. 5A PRIOR ART
FIG. 5A is a side view of a known connector.
Figure 5B:
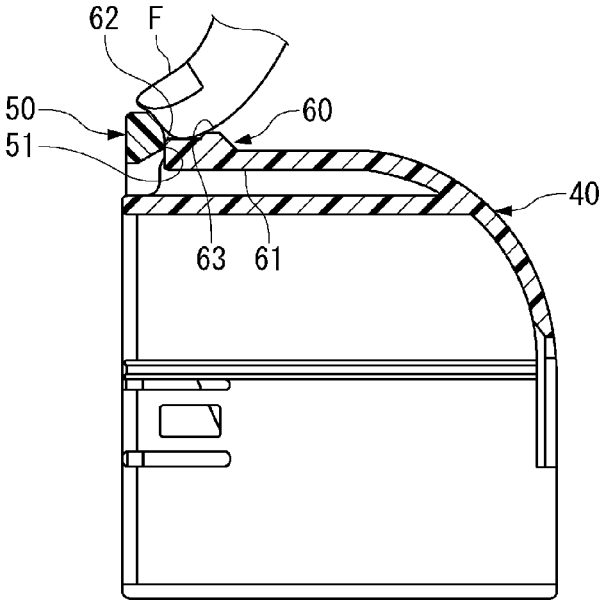
FIG. 5B PRIOR ART
FIG. 5B is a sectional view of the known connector.

Here, when the lever 20 is rotated to the completion position, the cover section 242 is interposed between the engaging section 32, the support rib 341, and the tip 31B side of the spring section 31, and the finger F to cover these portions at least from the time when the pressing surface 241A starts pressing the engaging section 32 as the lever 20 is positioned closer to the completion position to the time when the engaging section 32 engages the lever 20 as the lever 20 reaches the completion position. For this reason, as shown in FIG. 4, even when the position of the finger F is displaced from the pressing projection part 243 to a start position side, there is no chance for the finger F to touch the engaging section 32, the support rib 341, and the tip 31B side of the spring section 31. According to the configuration as discussed above, the spring section 31 can be reliably returned, and a sound and feeling perceived when the engaging section 32 abuts on the inside of the recessed part 241B are transmitted to an operator. Based on this awareness, the completion of the mating operation between the connector and the mating connector can be confirmed, and the mating operation of the connectors can be efficiently performed, thereby improving operability.

Note that when the lever 20 is at the completion position, the support end 31A side of the spring section 31 and the connection section 342 of the rib 34 are positioned away from the coupling part 24 compared with the engaging section 32, the support rib 341 of the rib 34, and the tip 31B side of the spring section 31, and are therefore difficult to be touched with the finger F and are also less prone to deflect if touched by the finger F. For this reason, the support end 31A side of the spring section 31 and connection section 342 of the rib 34 may not be covered with the cover section 242.

In the shown embodiment, the protection wall 121 is provided around the spring section 31. As described above, the protection wall 121 has a height equivalent to those of the engaging section 32 and the rib 34, and the space of the protection wall 121 in the width direction is narrow enough for the human finger F not to easily enter. Therefore, it is difficult to touch the engaging section 32, the rib 34, and the spring section 31 with the finger F when the lever 20 is operated toward the completion position. In addition, because of the provision of the protection wall 121, the support end 31A side of the spring section 31 and the connection section 342 of the rib 34 may not be covered with the cover section 242.

To release the mating between the connector and the mating connector, the release projection 33 positioned forward of the cover section 242 (forward in an operating direction when the lever is operated from the start position to the completion position) is pushed downward to cause the catch 241 to be away therefrom, thereby releasing locking by the lock 30. Then, when the lever 20 is directed backward to be rotated to the start position, the connector housing is withdrawn from the connector housing of the mating connector with a joined operation of the gear 22 and the rack, thereby releasing the mating of the connectors.

Note that if it is assumed that the coupling part 24 does not have the pressing projection part 243 and the cover section 242, nothing interferes with the finger F coming closer to the lock 30 as the lever 20 is positioned closer to the completion position, and the lock 30 is in a so-called exposed state. Therefore, there is a high possibility that the finger F touches the engaging section 32 of the lock 30 and the tip 31B side of the spring section 31.

Moreover, if the coupling part 24 has the pressing projection part 243, the finger F does not touch the lock 30 as long as the finger F presses the pressing projection part 243. If the finger F shifts from the pressing projection part 243, however, the finger F may touch the lock 30. That is, with the coupling part 24 having the cover section 242, the lock 30 can be reliably prevented from being touched with the finger F.

Note that while a wire cover mounted on a connector is used as an exemplary embodiment in above description, and the invention can be applied to a connector without having a wire cover mounted thereon, as a matter of course.

In addition to the description above, the structures mentioned in the embodiment described above can be selected and omitted and can be changed as appropriate to another structure as long as such selection, omission, and change do not deviate from the gist of the present invention.

The cover section in the present invention is not restricted to have a plate shape as illustrated in the embodiment described above covering the engaging part and the spring part without a gap, but includes those of various shapes, for example, a partially spaced shape such as a combed shape or a mesh shape, as long as the cover section can inhibit the finger from touching the engaging part and the spring part. Also, the present invention allows the cover section to cover the entire spring part of the lock.

What is claimed is:

1. A lever-type connector comprising:

a cover having a body and a lock with a spring section connected to the body and an engaging section connected to the spring section, the body includes a pair of side walls facing each other, an upper wall coupling upper ends of the pair of side walls together, a protection wall integrally formed with the upper wall, a pair of slits positioned between the spring section and the upper wall, and a coupling wall connecting the pair of side walls together on a front end side of the body, wherein the spring section extends away from the upper wall in a cantilever manner; and a lever connected to the body and having a rotatable pair of arms facing each other and a coupling part connecting the rotatable pair of arms together and engageable with the lock when the lever is rotated toward the lock, the coupling part having a cover section covering the engaging section and a portion of the spring section when the lock engages the lever.

2. The lever-type connector according to claim 1, wherein the spring section includes a support end positioned at one end thereof and connected to an upper wall of the body.

3. The lever-type connector according to claim 2, wherein the support end extends away from the upper wall to a tip.

4. The lever-type connector according to claim 3, wherein the engaging section is disposed on the tip.

5. The lever-type connector according to claim 4, wherein the cover section faces the engaging section and the tip when the lock engages the lever.

6. The lever-type connector according to claim 5, wherein the lock further includes a release projection extending from a lower end side of the tip.

7. The lever-type connector according to claim 1, wherein the body includes a hollow cavity with an open lower end part.

8. The lever-type connector according to claim 7, wherein the body includes a wire receiving space therein.

9. The lever-type connector according to claim 1, wherein the coupling part includes a catch disposed on a back surface thereof.

10. The lever-type connector according to claim 1, wherein a projection extends outward from the body and onto which the lever is rotatably supported.

11. The lever-type connector according to claim 10, wherein each of the pair of side walls includes a start position stopper.

12. The lever-type connector according to claim 9, wherein the catch includes a pressing surface and a recessed part positioned on a back side of the pressing surface.

13. The lever-type connector according to claim 12, wherein the coupling part further includes a pressing projection part provided on a front surface side the coupling part where the pressing surface is located.

14. The lever-type connector according to claim 1, wherein a front end of the upper wall and a upper end of the coupling wall are connected together by a connection section.

15. The lever-type connector according to claim 1, further comprising a plurality of ribs provided on an upper surface of the spring section extending to the engaging section.

16. The lever-type connector according to claim 1, wherein the protection wall extends from both of a top and bottom surface of the upper wall and along the spring section.

17. The lever-type connector according to claim 14, wherein the connection section is directed diagonally upward from the coupling wall to the upper wall.

* * * * *